US006006501A

United States Patent [19]

Davis et al.

[11] Patent Number: 6,006,501

[45] Date of Patent: Dec. 28, 1999

[54] THREE-SIDED POUCHES, MACHINE AND METHOD OF MAKING

[75] Inventors: Steven D Davis, Yuciapa; William A Lane, Redlands; Alvin L Taylor, Loma Linda, all of Calif.

[73] Assignee: Winpak Lane, Inc., San Bernardino, Calif.

[21] Appl. No.: 09/050,828

[22] Filed: Mar. 30, 1998

[51] Int. Cl.[6] ..... B65B 9/20

[52] U.S. Cl. ..... 53/451; 53/202; 53/467; 53/477; 53/551

[58] Field of Search ..... 53/202, 450, 451, 53/467, 477, 550, 551

[56] References Cited

U.S. PATENT DOCUMENTS

| | | | |
|---|---|---|---|
| 3,256,673 | 6/1966 | Tew et al. | 53/182 |
| 3,482,373 | 12/1969 | Morris | 53/112 |
| 3,861,121 | 1/1975 | Monsees | 53/239 |
| 4,009,551 | 3/1977 | Greenawalt et al. | 53/28 |
| 4,117,647 | 10/1978 | Rossi | 53/502 |
| 4,485,613 | 12/1984 | Saur | 53/551 |
| 4,552,613 | 11/1985 | Auer | 156/515 |
| 4,676,051 | 6/1987 | Hoskinson et al. | 53/451 |
| 4,745,731 | 5/1988 | Talbott et al. | 53/451 |
| 4,754,593 | 7/1988 | Ishihara et al. | 53/51 |
| 4,869,048 | 9/1989 | Boeckmann | 53/451 |
| 4,894,975 | 1/1990 | Ausnit | 53/412 |
| 4,909,017 | 3/1990 | McMahon et al. | 53/410 |
| 4,947,621 | 8/1990 | Christine et al. | 53/451 |
| 4,964,263 | 10/1990 | Ballestrazzi et al. | 53/555 |
| 4,991,379 | 2/1991 | Boeckmann | 53/552 |
| 5,054,270 | 10/1991 | McMahon | 53/552 |
| 5,127,208 | 7/1992 | Custer et al. | 53/412 |
| 5,231,817 | 8/1993 | Sadler | 53/451 |
| 5,235,794 | 8/1993 | Center | 534/437 |
| 5,241,804 | 9/1993 | Tsuruta et al. | 53/504 |
| 5,473,866 | 12/1995 | Maglecic et al. | 53/511 |
| 5,485,712 | 1/1996 | Cherney et al. | 53/436 |
| 5,505,037 | 4/1996 | Terminella et al. | 53/133.4 |
| 5,564,259 | 10/1996 | Stolmeier | 53/410 |
| 5,638,660 | 6/1997 | Kuo | 53/449 |
| 5,707,329 | 1/1998 | Pool et al. | 493/302 |
| 5,724,789 | 3/1998 | Corella | 53/450 |
| 5,753,067 | 5/1998 | Fukuda et al. | 156/358 |

*Primary Examiner*—Joseph J. Hail, III
*Assistant Examiner*—William Hong
*Attorney, Agent, or Firm*—James G. O'Neill

[57] ABSTRACT

A form, fill and seal packaging machine having at least one multi-channel former therein for forming a pair of streams of three side sealed pouches. The at least one multi-channel former includes a shaped top and an open central forming area in which a strip of material brought to the former by a drive means from a roller is bent over and is then folded into a unique figure 8 or infinity sign, tubular configuration as it exits from the bottom. The unique configuration is then side sealed and cut into two tubular elements, which are then bottom sealed, filled, top sealed and cut-off in the machine to form two separate streams of three side sealed pouches. The machine may have a number of separate forming areas therein and the unique tubular configuration from which the pouches are formed is provided by the unique shaped top, open central and exit configurations of the formers, over and through, which the strip of material is bent and folded.

20 Claims, 2 Drawing Sheets

28
14
20
18
16
10
16
22
18
26
15
13
3
3
12
30
32
34
36
38
40

10
20
18
20
13
20
24
22
20
24
14
26
26
26

THREE-SIDED POUCHES, MACHINE AND METHOD OF MAKING

BACKGROUND OF THE INVENTION

1. Field of the Invention

This invention relates generally to pouches, and more particularly, to a packaging machine for forming, filling and sealing three-sided, flexible pouches, and a method of making the same.

2. Description of Related Art

Because of the technical advances in film pouch forming, filling and sealing machines, more and more food and other products, are being packaged in flexible film pouches for ease in shipping, handling and dispensing, or for sale, as well as for health and sanitary reasons. Known form, fill and seal pouch forming machines are usually referred to as horizontal or vertical machines, and form pouches of various configurations utilizing one or more continuous webs of heat-sealable plastic film, taken off of rolls. The plastic film can also be provided with other layers of material, as needed or required. The finished pouches from such machines are generally sealed on four sides, after being formed in continuous streams from the roll or rolls of film, filled with a product, sealed, and then cut off in a continuous process.

The known machines also include packaging machines which form a single stream of three-sided pouches, and in particular, machines which form such single stream of pouches vertically, i.e., in which the material from which the pouches being are formed, filled and sealed travels from the top of the machine down toward the bottom thereof.

Known machines for forming three-sided packages or pouches include a former, generally made from sheet metal or other easily bendable material. The former takes the material, which is unwound from a supply roller, and folds the same into a tubular configuration around a mandrel and/or a pouch filling tube. A lap seal is then formed between the overlapping ends of the formed tubular material. The formed tubular material is then indexed through the machine, so as to first form a bottom cross seal, then to fill a partially formed package with material, and to then form a top seal, and to finally cut off the finally formed package or pouch. Sometimes, in an attempt to avoid the expense of shipping too much material, after some of the seals are formed on a pouch, the seals are trimmed off, to lower the weight thereof.

Examples of known single channel, vertical three-sided sealed pouch packaging machines are disclosed in U.S. Pat. Nos. 3,482,373, 3,861,121, 4,117,647, 4,485,613, 4,676,051, 4,947,621, 4,964,263 and 5,231,817.

An example of a machines which forms four-sided pouches, but which utilizes formers to form tubular preforms for filling sealed thermoplastic bags with a fragile, low-density product, such as potato chips, corn chips, tortilla chips, etc., is disclosed in U.S. Pat. No. 5,235,794. In this machine, one or two continuous thermal plastic sheets of material are unrolled from rollers and advanced and formed into a plurality of vertical, tubular, preforms having vertical side seals on opposing sides thereof. The side seals are then cut and formed with bottom seals, and filled, provided with a top seal and cut off, as disclosed therein.

Still other machines, such as shown in U.S. Pat. Nos. 3,256,673 and 4,552,613, disclose a machine which forms two channels or streams of three-sided pouch packages, from two, side-by-side tube shaping devices. In these machines however, each channel or stream of pouches being formed is formed separately from the other, with identical formers, sealing mechanisms and cut-off mechanisms thereon.

Although existing packaging machines work well, they have numerous drawbacks and/or problems, such as the need for duplication of complex components and elements, and when forming three-sided packages or pouches, are incapable of quickly and simultaneously forming such pouches in a multichannel machine.

Furthermore, in today's highly competitive business environment, there is a constant need to lower costs and reduce materials usage, as well as the need for saving energy and the forming of pouches with more appealing, eye-catching appearances. Therefore, packages or pouches with only three sealed side edges are in demand, since they provide savings in energy and material, by, inter alia, decreasing the need to form a fourth sealed side. Additionally, three-sided pouches enable front and back graphics to be printed on the pouches and across the unsealed side, and to be more easily maintained in registration in the machine.

Therefore, there exists a need in the package and dispensing art for a machine and method for making a plurality of channels of three-side sealed pouches in a fast, economical and efficient manner, and which overcomes the known problems, while offering cost and energy savings over and above those known from prior art machines.

SUMMARY OF THE INVENTION

Accordingly, it is a general object of the present invention to provide an improved form, fill and seal packaging machine. It is a more particular object of the present invention to provide an improved form, fill and seal packaging machine which economically and efficiently forms, fills and seals a plurality of streams of three-sided pouches. It is a further particular object of the present invention to provide an improved method of forming multiple channels of three-side sealed pouches in a form, fill and seal packaging machine. It is yet another particular object of the present invention to provide an improved vertical form, fill and seal packaging machine, having unique, multi-channel forming areas for forming a plurality of streams of pouches therein. It is a still further particular object of the present invention to provide an improved form, fill and seal packaging machine, having at least one forming station which forms incoming material into a tubular figure 8 or infinity configuration. It is yet a still further particular object of the present invention to provide an improved method of forming pouches in a multiple channel form, fill and seal packaging machine in which the material is first formed into a tubular figure 8 or infinity configuration, having indented ends thereon. It is a still further particular object of the present invention to provide a unique, multi-unit former, having the capability of forming a plurality of vertical streams of pairs of three-sided pouches.

In accordance with one embodiment of the present invention there is provided a vertical form, fill and seal packaging machine, having at least one forming station to form multiple channels of three side sealed pouches, and in which the material to be formed is fed into a shaped forming area where it is folded into a tubular, extended figure 8 configuration. The tubular figure 8 configuration is then sealed along a central portion, to form two side-by-side, tubular elements. The forming area may include internal elements for indenting the ends of the tubular figure 8 configuration, to form pouches having indented ends, which are capable of being supported on the indented, unsealed ends.

BRIEF DESCRIPTION OF THE DRAWINGS

The above and other features of the invention will be better understood from the following detailed description of the preferred embodiments illustrated in the accompanying drawing in which.

DESCRIPTION OF THE PREFERRED EMBODIMENTS

The following description is provided to enable any person skilled in the art to make and use the invention, and sets forth the best modes contemplated by the inventors of carrying out their invention. Various modifications, however, will remain readily apparent to those skilled in the art, since the generic principles of the present invention have been defined herein, specifically to provide for a novel and improved form, fill and seal packaging machine for forming multiple channels of three-sided sealed pouches, and the improved method for making multiple channels or streams of three-sided pouches in a single machine.

Figure 1:
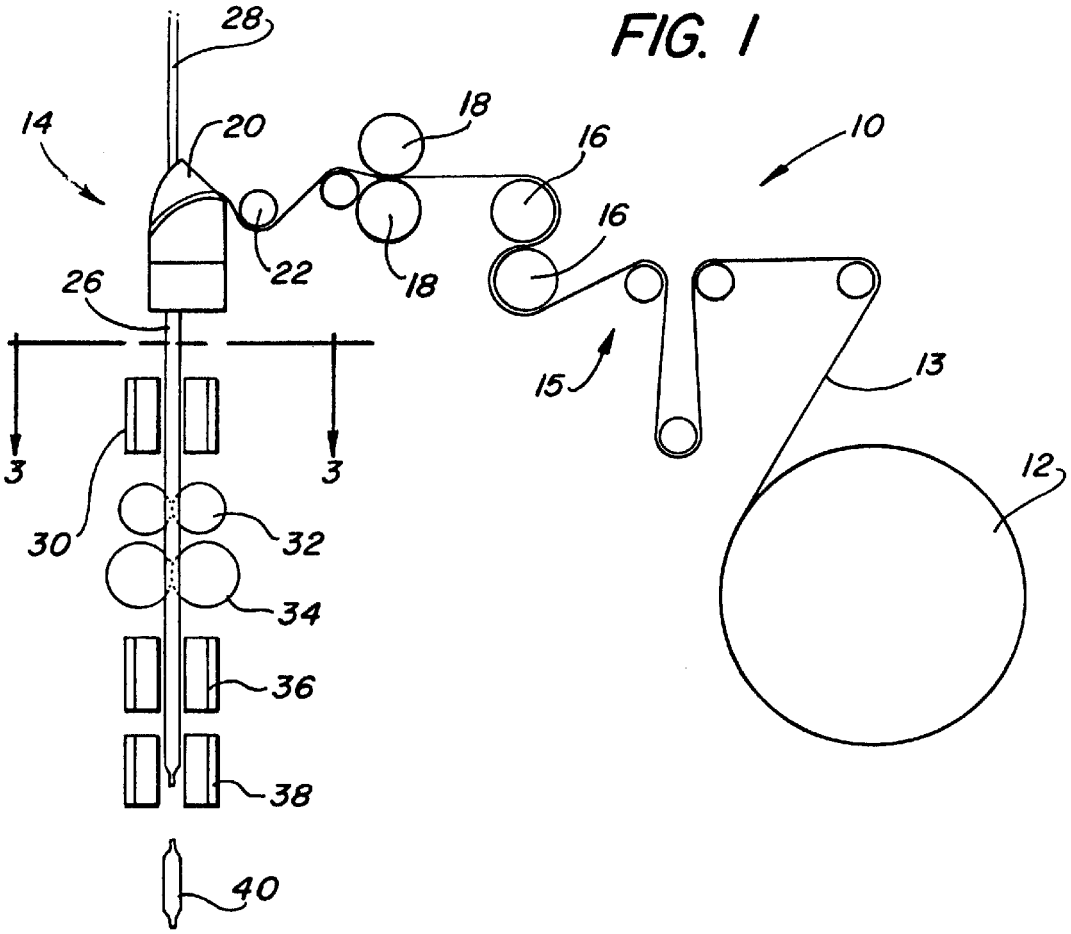
FIG. 1 is a schematic representation of a multi-channel pouch form, fill and seal machine, in accordance with the present invention.

Turning now to the drawings, FIG. 1 shows a schematic representation of a vertical form, fill and seal packaging machine of the present invention, generally indicated at 10. The machine 10 may take any desired shape, and have any size or shape frame, provided that a roll 12, comprised of a web of flexible material 13, such as a heat-sealable plastic, is mounted at the rear thereof, below a material forming station 14. The web of flexible material 13 is unwound or unrolled off of the roll 12, around a plurality of rollers 15 by, for example, a pair of nip or takeup rollers 16 mounted at the top of the machine, before the forming station 14.

Figure 2:
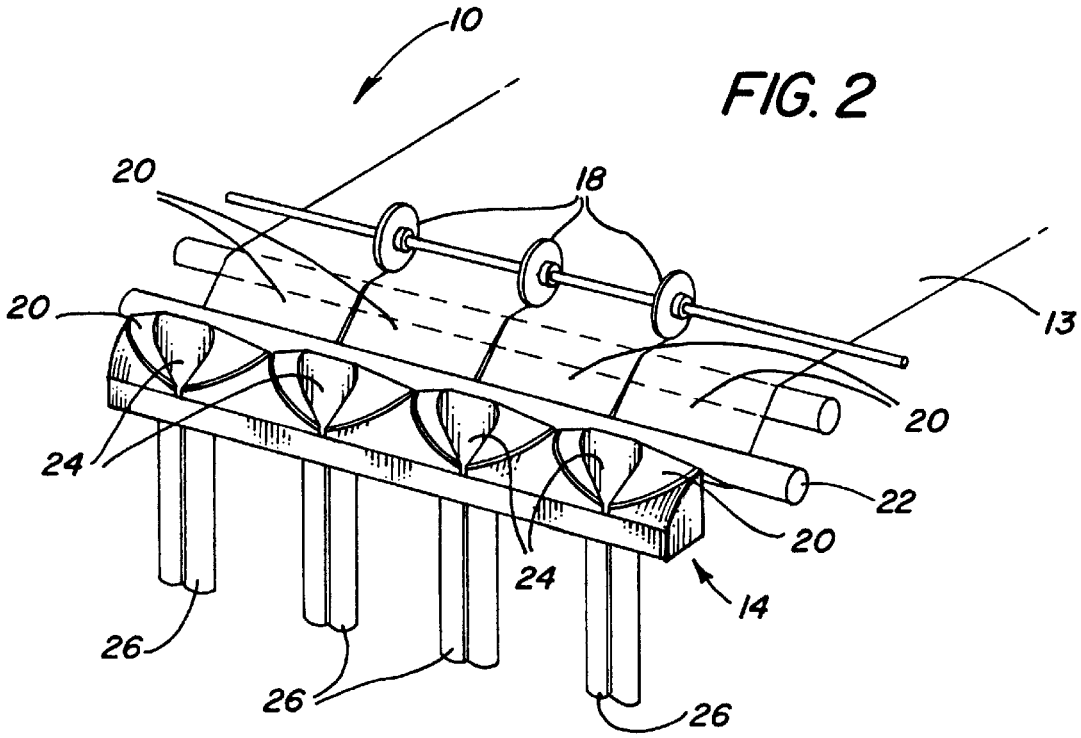
FIG. 2 is a partial perspective view of the top of a machine of the present invention showing a novel forming station for simultaneously forming multi-channels of pairs of three side sealed pouches.
Figure 3:
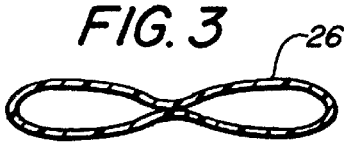
FIG. 3 is a cross-sectional view, taken along line 3—3 of FIG. 1, showing an extended figure 8 configuration of one tubular element, after having passed through one of the forming areas.

As shown more clearly in FIG. 2, positioned immediately adjacent to the nip roller 16 are a plurality of cutting elements or wheels 18, to slit the web of material 13 into a plurality of separate strips 20. Although, four strips 20 are shown in FIG. 2, any desired number of strips may be formed, depending on the width of the machine 10, and the number of forming areas in the machine, as described more fully below. After being cut, the strips 20 pass under a tension roller 22. The tension roller 22 is lower than one or more specifically shaped top surfaces 23 of the forming station 14 so as to allow the separate strips 20 to be guided over the shaped top surface 23, and into at least one open forming area 24, located toward the front of the shaped top surface. The shaped top surfaces 23 are provided with complex curved shapes, extending from the rear thereof to an open front area, and preferably include a finish that reduces friction. The strips 20 are easily pulled across the complex curved shape of the top surfaces and over the reduced friction surface, without requiring an undue amount of force, to thereby save wear on the top surfaces 23 and prevent the strips 20 from breaking. After flowing or passing over one or more shaped top surfaces 23, from the tension roller 22 at the rear of the forming station 14 to an open area at the front of the top surface 23 (see FIGS. 2 and 7), each strip 20 is guided into an open forming area 24. Each open forming area 24 preferably has an elongated elliptical shape extending entirely through the former, until it meets a shaped exit portion, explained more fully below. Therefore, each strip 20 is folded over or formed so as to produce an elongated, tubular element 26 in the configuration of an extended figure 8, or an infinity sign (see FIGS. 2 and 7). That is, the plurality of shaped top surfaces 23, open forming areas 24, and exit openings 42, 42', described below, are so shaped and sized that each strip 20 forms an elongated tubular element having a cross section which is an extended figure 8 configuration 26, best shown in FIG. 3.

Figure 4:
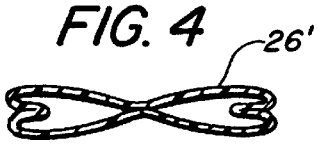
FIG. 4 is a cross-sectional view of a further embodiment of a tubular element, taken along a line similar to 3—3 in FIG. 3, showing a modified tubular, extended figure 8 configuration, having indented ends.
Figure 8:
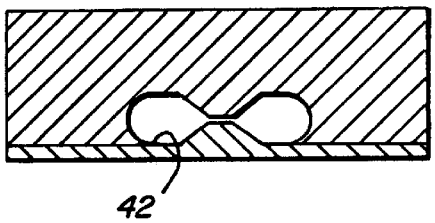
FIG. 8 is a cross-sectional view, taken along line 8—8 of FIG. 7 showing the structure of the exit of the former.
Figure 9:
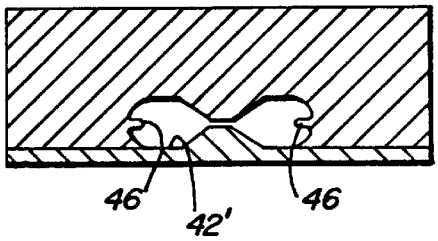
FIG. 9 is a cross-sectional view of a modified former taken along a line similar to 8—8 of FIG. 7, showing the structure of the exit of a former having inwardly extending fingers at each end to form the indented end tubular figure 8 configuration of material shown in FIG. 4.

A further embodiment of a former 14' of the present invention is shown in FIG. 9. In this embodiment, the top surface 23 and top of the open forming area 24 will be identical to that shown in FIGS. 1 and 7. However, the shaped exit or lower portion 42, is provided with internally extending indentations or fingers 46, at either end of an elongated figure 8 cross section, to form a modified tubular figure 8 configuration 26', having identical indented ends, as shown in FIGS. 4 and 6.

Figure 5:
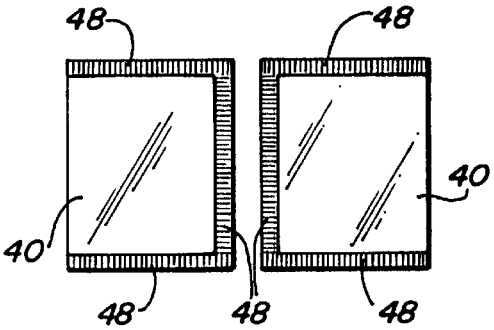
FIG. 5 is a front elevational view of a pair of finished pouches formed from the tubular, extended figure 8 configuration of material shown in FIG. 3.
Figure 6:
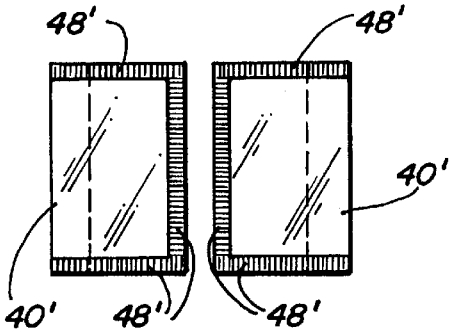
FIG. 6 is a front elevational view of a pair of modified pouches formed from the tubular, extended figure 8 configuration of material shown in FIG. 4.

After exiting through exit openings 42, 42' in formers 14, 14', the tubular elements 26, 26' have bottom seals formed thereon, are then filled with material, sealed at the top, and cut-off, to form pairs of finished packages or pouches 40, 40', as best shown in FIGS. 5 and 6. That is, after exiting from exit openings 42, 42' of each of the open-shaped forming areas 24, multiple channels or streams of extended figure 8 configured, tubular elements 26, 26' will be formed.

Figure 7:
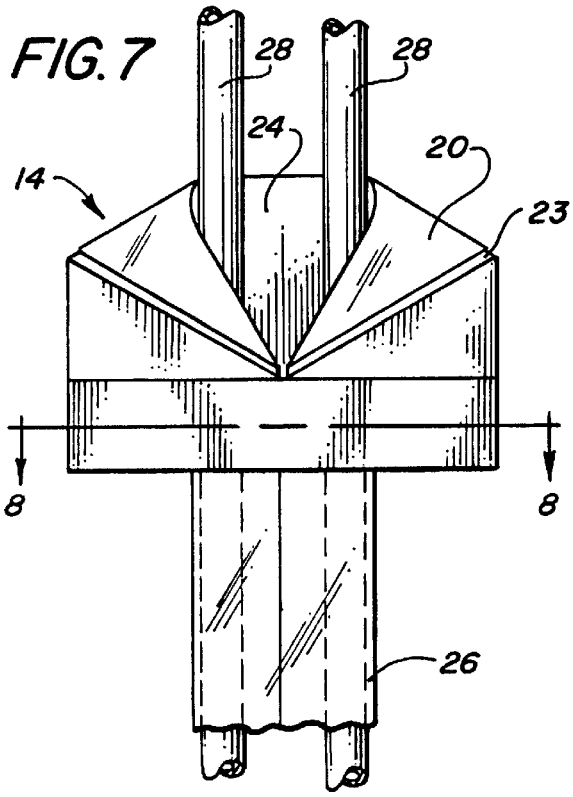
FIG. 7 is a front elevational view of a single multi-channel former, in accordance with the present invention.

As best shown in FIGS. 1 and 7, a pair of fill tubes 28 are provided and pass through each of the open forming areas 24. Side seals are first formed centrally on each configured, tubular element 26, or centrally and at both ends of each configured, tubular element 26', at a side seal station 30. A further pair of drive rollers 32 aids in pulling the tubular, configured elements 26, 26' through the forming station 14, across top surface 23, into open forming area 24, and through the exit openings 42, 42'. A pair of cutting elements 34, selectively mounted either before or after the drive rollers 32, then cuts or slices each of the configured, elongated tubular elements 26, 26' into two separate elongated tubes or tubular elements having a single side seal. The cut or separated elongated tubes are then indexed to a transverse seal forming station 36, where bottom seals on first pouches, and top seals on second pouches below the first pouches, are made. The partially formed pouches are then filled with a predetermined amount of material from the filling tubes 28, the machine indexed again, and top seals formed on the just-filled pouches, either at the same station 36 or at a lower sealing and cut-off station 38. Or, if the top seal is formed at station 36, station 38 will only cut-off the formed and sealed three-sided pouches, to form separated, complete pouches, such as the pairs of pouches 40, shown at the lower end of FIG. 1, and in FIG. 5, or pouches with indented ends, as shown at 40' in FIG. 6, from each open forming area 24.

It is to be understood that multiple channels or streams of pairs of pouches 40, 40' are being formed in the machine 10. That is, for each of the open forming areas 24 in the machine, whether one, six, or more, a pair of three-sided pouches 40, 40', such as shown in FIGS. 5 and 6, will be formed, depending on whether the exit portion is shaped as shown at 42 in FIG. 8, or 42' as shown in FIG. 9.

Basically, as shown in the drawings, after being formed, filled and sealed, at least one pair of three-sided pouches 40, 40' are cut-off and ready for use. As shown most clearly in FIGS. 5 and 6, these formed pouches 40, 40' contain only three side seals 48, 48', therefore, providing an approximate 10% decrease in the cost of materials used, because no fourth side seal has to be made. Additionally, lower secondary packaging costs are obtained, such as in corrugated boxes used to ship these three side sealed pouches. That is, because no fourth side seal is contained therein, the packages are smaller and will take up less space when packaged in corrugated boxes. Therefore, the corrugated boxes may also be made smaller, or if currently sized corrugated boxes are used, they may be used to ship more three sided, sealed packages. Furthermore, in the manufacture of the pouches of the present invention, less energy is required since no fourth side seal has to be made. Also, there is less scrap to dispose of since less material is used in forming such pouches. And, the end users of such three-sided pouches can also save, since they need less room to store their inventory of such reduced size, three-sided, sealed pouches. Finally, the three side sealed pouches of the present invention provide more advertising or promotional space thereon, which space can extend over both sides, as well as the unsealed side edge. These ads will always be in register due to the forming operation of the machine. Also, an advantage over other multiple channel machines because it slits the film into pairs of packages, thus reducing stress across the film width that occurs during forming. This reduces cross seal wrinkles, thus preventing leakage ("leakers").

It, therefore, can be seen that the unique forming stations and the machine to make the same of the present invention provide a novel, multi-channel machine for making multiple channels or streams of three-sided pouches in a faster and more economical manner. The novel method of the present invention allows pairs of three-sided pouches to be formed in a faster and more efficient manner.

Those skilled in the art will appreciate that there are adaptations and modifications of the just-described embodiment which can be configured without departing from the scope and spirit of the invention. Therefore, it is to be understood, that within the scope of the intended claims, the invention may be practiced other than as specifically described herein.

What is claimed is:

1. A packaging machine to vertically form, fill and seal at least one stream of a pair of three-sided pouches comprising, in combination:

means for holding a roll of material in the machine;

means for feeding a web of the material from the roll to a cutting station;

means for slitting the web of material into at least one strip of material;

a forming station receiving the at least one strip of material;

at least one curved top surface and at least one open forming area ending in an opening in the forming station for receiving, bending and folding the at least one strip of material into an elongated tubular element having a preselected cross section to form a pair of streams of pouches;

means in the packaging machine, after the forming station, for forming a side seal, a bottom seal, a top seal and to cut-off a formed pair of three-sided pouches; and a plurality of filling tubes passing through the at least one curved top surface, the at least one open forming area and the exit opening, to fill the pair of streams of pouches with a predetermined amount of a selected material.

2. The packaging machine of claim 1 wherein the forming station has a plurality of curved top surfaces, a plurality of open forming areas with exit openings, and the means for slitting the web of material slits the material into a plurality of strips of material, equal in number to the number of curved top surfaces.

3. The packaging machine of claim 1 wherein the at least one curved top surface is shaped and sized to reduce the friction of the at least one strip of material flowing over the at least one curved top surface.

4. The packaging machine of claim 3 wherein the at least one open forming area is located in a front portion of the at least one curved top surface, and the exit opening is sized and shaped as an extended figure 8 so as to form an elongated tubular element, having an extended figure 8 cross section.

5. The packaging machine of claim 4 wherein there are a plurality of curved top surfaces and a plurality of open forming areas having extended figure 8-shaped exit openings in the forming station, and the means for slitting the material, slits the material into a plurality of strips of material, equal in number to the number of curved top surfaces.

6. The packaging machine of claim 4 wherein there are a plurality of open forming areas located at a front portion of the plurality of curved top surfaces, and the plurality of open, forming areas include exit openings having a pair of extending elements therein; the exit openings being sized and shaped as an extended figure 8 so as to form elongated tubular elements, having extended figure 8 cross sections with indented ends.

7. The packaging machine of claim 1 wherein a pair of streams of three-sided, sealed pouches is formed from the at least one strip of material passing over the at least one curved top surface, into the at least one open forming area and out of the exit opening.

8. The packaging machine of claim 7 wherein there are a plurality of curved top surfaces and a plurality of open forming areas having exit openings, and each of the plurality of curved top surfaces, the plurality of open forming areas, and the exit openings have a pair of filling tubes passing there through.

9. The packaging machine of claim 8 wherein the exit openings have a pair of extending elements formed therein, and each exit opening is sized and shaped as an elongated figure 8 so as to form a tubular element, having an extended figure 8 cross section with indented ends.

10. The packaging machine of claim 8, further including means in the exit openings to form indentations at opposite ends of the elongated tubular elements exiting therefrom.

11. The packaging machine of claim 8 wherein each of the exit openings has an extended figure 8 cross section that forms a pair of streams of three-sided, sealed pouches.

12. The packaging machine of claim 8 wherein the plurality of curved top portions have complex curves formed thereon, extending from the rear thereof to an open front area.

13. The packaging machine of claim 8 wherein the plurality of curved top portions are provided with a finish that reduces friction.

14. A method of forming a pair of three-sided pouches comprising the steps of:

forming a former having a curved top portion, an elliptical-shaped inner opening and an elongated figure 8-shaped exit opening;

passing a strip of material over the curved top portion, into the elliptical-shaped inner opening, and out of the elongated figure 8-shaped exit opening so as to form the strip of material into an elongated tubular element having an extended figure 8-shaped cross section; and filling and sealing the elongated tubular element having the extended figure 8-shape cross section into two continuous streams of three-sided pouches.

15. The method of claim 14, further including the step of forming a former having a plurality of curved top portions, a plurality of elliptical-shaped inner openings and a plurality of elongated figure 8-shaped exit openings; and passing a plurality of strips of material over the curved top portions, into the plurality of elliptical-shaped inner openings, and out of the plurality of elongated figure 8-shaped exit openings so as to form a plurality of tubular elements having an extended figure 8-shape cross section.

16. A packaging machine to vertically form, fill and seal a plurality of streams of three-sided pouches comprising, in combination:

a roll of flexible web material mounted in the machine;

take-up means for feeding the flexible web material from the roll to a cutting station;

a plurality of cutting blades for slitting the web material into a plurality of strips of material;

a forming station receiving the plurality of strips of material;

a plurality of curved top surfaces and a plurality of open forming areas having extended figure 8-shaped exit openings to form a plurality of tubular element, having an extended figure 8 cross section for forming a plurality of pairs of streams of pouches;

means mounted in the packaging machine, after the forming station, for forming side seals, bottom seals, top seals and to cut-off formed pairs of three side pouches; and a pair of filling tubes passing through the each of the curved top surfaces, the open forming areas and the extended figure 8-shaped exit openings to fill pouches with a predetermined amount of a selected material.

17. The packaging machine of claim 16 wherein the plurality of open forming areas are located at a front portion of the plurality of curved top surfaces, and include elongated figure 8-shaped exit openings having a pair of extending elements therein; the elongated figure 8-shaped exit openings being sized and shaped so as to form elongated tubular elements, having extended figure 8 cross sections with indented ends.

18. The packaging machine of claim 16 wherein each of the elongated figure 8 shaped exit portions is sized and shaped so as to form elongated tubular elements having an extended figure 8 cross section that is formed into a pair of streams of three-sided, sealed pouches.

19. The packaging machine of claim 16 wherein the plurality of curved top portions have a number of curves formed thereon, extending from the rear thereof to an open front area.

20. The packaging machine of claim 19 wherein the plurality of curved top surfaces are provided with a finish that reduces friction.

* * * * *